US008065944B1

(12) United States Patent
Speas, Jr.

(10) Patent No.: US 8,065,944 B1
(45) Date of Patent: Nov. 29, 2011

(54) PORTABLE CUTTER WITH ADJUSTABLE CUTTING BLADE TOOLS FOR CUTTING DIFFERENT WIDTHS OF THIN SHEET ROLL MATERIAL

(76) Inventor: Clay Speas, Jr., Castle Rock, CO (US)

( * ) Notice: Subject to any disclaimer, the term of this patent is extended or adjusted under 35 U.S.C. 154(b) by 370 days.

(21) Appl. No.: 12/319,705

(22) Filed: Jan. 12, 2009

(51) Int. Cl.
*B26D 7/00* (2006.01)
*B26D 1/04* (2006.01)
*B26D 7/01* (2006.01)

(52) U.S. Cl. ..... 83/649; 83/614; 83/698.21; 83/522.11; 83/485

(58) Field of Classification Search ..... 83/698.21, 83/614, 408, 76.9, 564, 578, 522.11, 485, 83/649, 455; 225/7, 16, 23, 38, 17, 88
See application file for complete search history.

(56) References Cited

U.S. PATENT DOCUMENTS 2,747,664 A * 5/1956 Corson ..... 83/408
2,940,170 A * 6/1960 Matter ..... 30/293
3,296,911 A * 1/1967 McLane ..... 83/408
3,748,939 A * 7/1973 Feinstein et al. ..... 83/370
3,786,705 A * 1/1974 Dorfel ..... 83/76.7
4,351,208 A * 9/1982 Cobleigh et al. ..... 83/167
5,025,692 A * 6/1991 Reynolds ..... 83/468
5,103,710 A * 4/1992 Ross ..... 83/485
5,186,091 A * 2/1993 Wolf ..... 83/649
5,379,671 A * 1/1995 Kang ..... 83/698.11
5,505,109 A * 4/1996 Okonski et al. ..... 83/622
5,613,415 A * 3/1997 Sanpei ..... 83/86
5,894,978 A * 4/1999 Welch et al. ..... 225/7

* cited by examiner

*Primary Examiner* — Ghassem Alie
(74) *Attorney, Agent, or Firm* — Edwin H. Crabtree; Ramon L. Pizarro

(57) ABSTRACT

A portable cutter used for cutting different widths of thin sheet material. The portable cutter includes a right angle measurement bar with scale adapted for receipt against a front side of an open top storage box. The storage box is used for holding a large roll of thin sheet material therein. At least one cutting blade tool is adjustably mounted along a length of the measurement bar. The cutting blade tool includes a cutting blade disposed between a horizontal upper blade guide arm and a horizontal lower blade guide arm. Attached to a portion of the lower blade guide arm is a magnet holder with magnet used for releasable attachment to the measurement bar.

9 Claims, 2 Drawing Sheets

PORTABLE CUTTER WITH ADJUSTABLE CUTTING BLADE TOOLS FOR CUTTING DIFFERENT WIDTHS OF THIN SHEET ROLL MATERIAL

BACKGROUND OF THE INVENTION (a) Field of the Invention

This invention relates to a portable cutter used for cutting thin sheet roll material and more particularly, but not by way of limitation, to a portable cutter mounted on an open side of a storage box. The storage box is used for holding a large roll of thin sheet material. The portable cutter includes at least one adjustable cutting blade tool for cutting different widths of the thin sheet roll material as it's unrolled from inside the storage box.

(b) Discussion of Prior Art

Heretofore, different types of plastic, cloth and other thin sheet materials, having different lengths, have been sold in a large, single roll inside a storage box. As the material is rolled, it is placed on a table and cut to length and width by hand and using a knife or scissors. The method of cutting thin sheet material is time consuming and quite often inaccurate in measurement leading to wasted material. The subject invention provides unique combination of structure and function for eliminating the need for cutting thin sheet material by hand or using complex roll cutting equipment.

SUMMARY OF THE INVENTION

In view of the foregoing, it is a primary objective of the subject invention to provide an inexpensive, lightweight, portable cutter for mounting on the inside of an open top storage box for quickly cutting thin sheet material, as it's unrolled, to one or more desired widths and lengths.

Another object of the invention is the portable cutter includes one or more cutting blade tools that can be adjusted on a right angle measurement bar for cutting the thin sheet material in various selected widths.

The subject invention includes a right angle measurement bar with scale adapted for receipt inside an open top storage box. The storage box is used for holding a large roll of thin sheet material therein. At least one cutting blade tool is adjustably mounted along a length of the measurement bar. The cutting blade tool includes a horizontal upper blade guide arm and a horizontal lower blade guide arm. A cutting blade is disposed between the upper blade guide arm and the lower blade guide arm and attached thereto. The cutting blade is used for cutting the thin sheet material. Attached to a portion of the lower blade guide arm and extending outwardly therefrom is a magnet holder with magnet mounted thereon. The magnet is used for releasable attachment to a metal strip attached to an underside of a horizontal portion of the measurement bar. In operation and by adjusting the cutting blade tool along the length of the measurement bar, different widths of the thin sheet material can be cut as the material is unrolled from the storage box. The measurement bar is also used as a cutting edge for cutting the thin sheet material to length.

These and other objects of the present invention will become apparent to those familiar with various types of cutting tools used for cutting thin sheet roll material when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
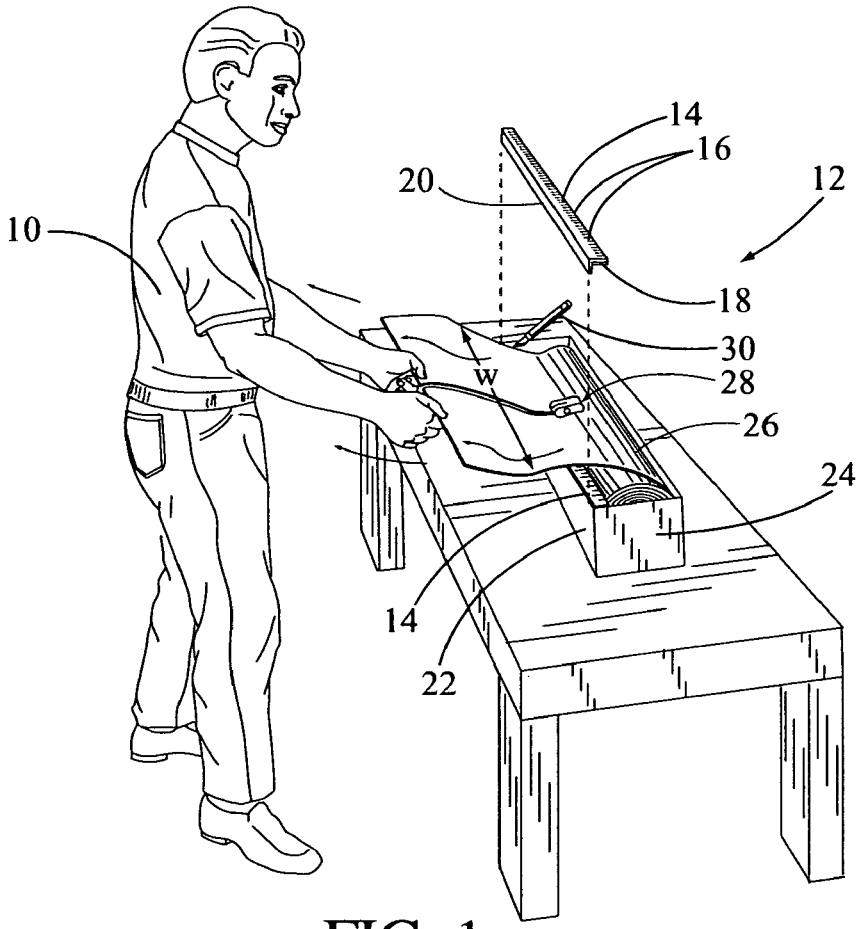
FIG. 1 is a perspective view of an operator using the subject portable cutter attached to a front side of an open top storage box and unrolling thin sheet material therefrom and cutting the thin sheet material to a selected width.

In FIG. 1, a perspective view of an operator 10 is shown and using the subject portable cutter, having a general reference numeral 12. The portable cutter 12 includes a right angle measurement bar 14 having a scale 16 along a length of a horizontal portion 18 of the bar 14. The measurement bar 14 may come in various lengths, such as 20 inches, 24 inches, 36 inches, 48 inches, 60 inches and 72 inches. The bar 14 is made of aluminum or similar non-metallic material. The scale 16 may be inches and feet and/or millimeters and centimeters. The measurement bar 14 also includes a vertical portion 20.

In this drawing, the bar 14 is shown positioned next to a front side 22 of an open top storage box 24. Opposite ends of the bar 14 rest on end caps mounted inside the storage box 24 with the vertical portion 20 held against the inside of an upper portion of the front side 22. The end caps are not shown in the drawings. The storage box 24 includes a large roll of thin sheet material 26 having a width "W". The opposite ends of the roll of thin sheet material 26 are attached to the end caps for unrolling thereon. The width "W" may vary in size and typically is in a range of 20 inches up to 72 inches. While the measurement bar 14 is mounted next to the inside of the front side 22 of the storage box 24, it should be kept in mind that the bar 14 can be secured in various ways to the storage box and without departing from the spirit and scope of the invention.

Also shown in this drawing is the operator 10 unrolling the thin sheet material 26 with the material being cut to a specific width using an adjustable cutting blade tool, having general reference numeral 28. The cutting blade tool 28 is attached to an underside of the horizontal portion 18 of the measurement bar 14. The length of the measurement bar 14 is greater then the width "W" of the sheet material 26 with the scale 16 used to adjust the cutting blade tool 28 for cutting a desired width of material.

For example, if the width "W" of the sheet material 26 is 48 inches, the cutting blade tool 28 can be placed on the 24 inch mark on the scale 16 and the sheet material cut into two equal widths of 24 inches each. Also, a knife 30 or scissors can be used next to the side of the measuring bar 14 with the upper edge of the vertical portion 20 used as a cutting edge for cutting the sheet material 26 to a desired length.

Figure 2:
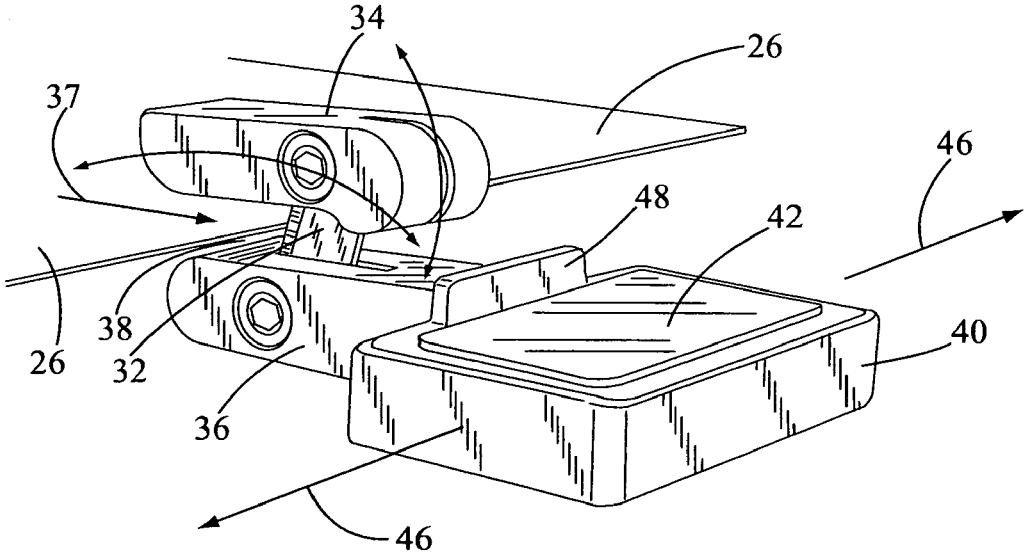
FIG. 2 is an enlarged perspective view of a cutting blade tool used for cutting the thin sheet material as it's unrolled.

In FIG. 2, an enlarged perspective view of the cutting blade tool 28 is shown and used for cutting the thin sheet material 26 as it's unrolled from the storage box 24. The cutting blade tool 28 includes a cutting blade 32 disposed between an upper blade guide 34 arm and a lower blade guide arm 36 and attached thereto. The cutting blade 32 is used for cutting the thin sheet material 26 as it's guided, as indicated by arrow 37, inside a space 38 between the guide arms 34 and 36. The guide arms 34 and 36 provide for a smooth flow of the thin sheet material 26 is guided between the arms and cut by the cutting blade 32.

Figure 3:
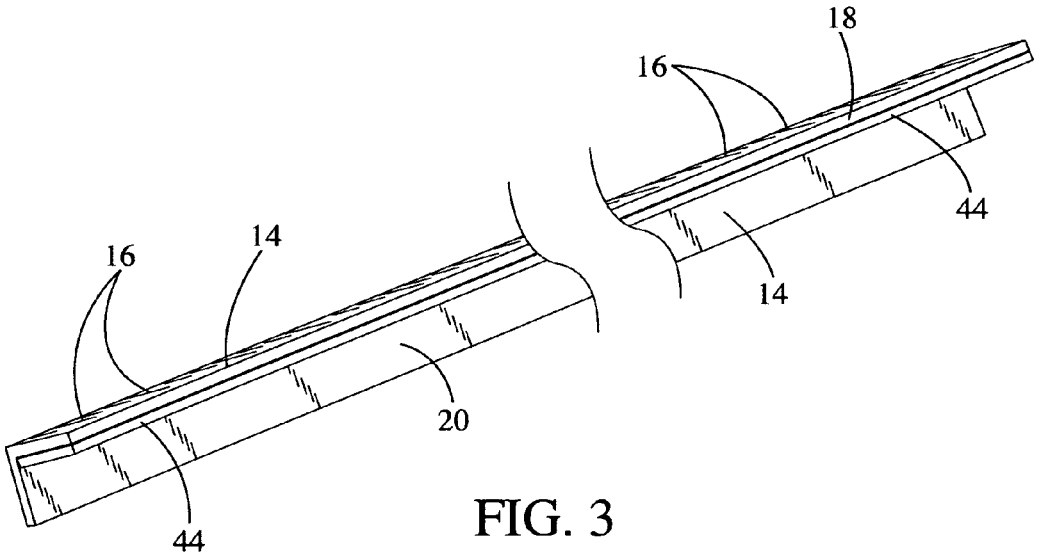
FIG. 3 is a perspective view of a right angle measurement bar with scale and a metal strip attached to the under side of a portion of the measurement bar.

Attached to a rear portion of the lower blade guide arm 36 and extending outwardly therefrom is a magnet holder 40 with magnet 42 mounted thereon. The magnet 42 is used for releasable attachment to a metal strip 44 attached to an underside of a horizontal portion 18 of the measurement bar 14. The metal strip 44 is shown in FIG. 3. Arrows 46 are shown to indicate that the cutting blade tool is adjustable along the length of the measurement bar 14. Also, the magnet holder 40 includes an upwardly extending bumper stop 48 which is used to engage a side of the horizontal portion 18 of the measurement bar 14 when attached thereto, as shown in FIG. 4.

In FIG. 3, a perspective view of a right angle measurement bar 14 is shown with scale 16 on the horizontal portion 18 of the bar. Also in this drawing, the metal strip 44 is shown attached, using double sided adhesive tape, to the under side of a vertical portion 20 of the measurement bar 14.

Figure 4:
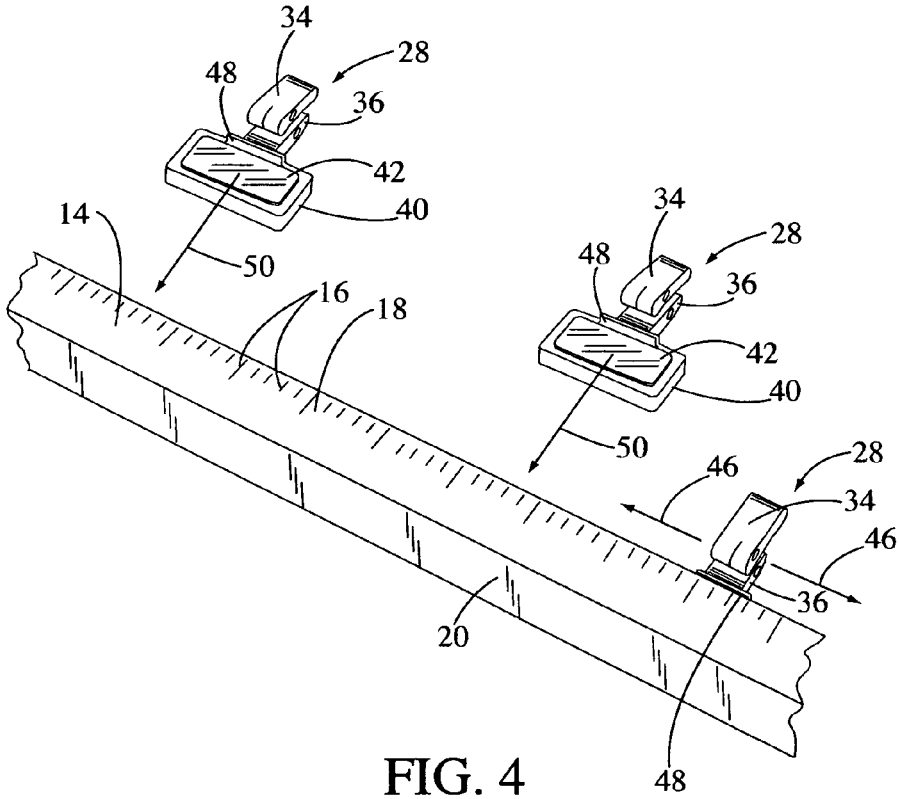
FIG. 4 is another perspective view of the measurement bar illustrating a pair of spaced apart, cutting blade tools positioned for attachment thereto and prior to cutting the thin sheet material to various widths.

In FIG. 4, another perspective view of the measurement bar 14 is illustrated showing a pair of spaced apart cutting blade tools 28 positioned for attachment, as indicated by arrows 50, to the underside of the horizontal portion 18 of the bar 14. Also, a third cutting blade tool 28 is shown already attached to the horizontal portion 18 of the bar 14. Obviously, as shown in this drawing, one, two or more cutting blade tools 28 can be attached to the measurement bar 14 for cutting the thin sheet material 26 to various selected widths. It should be kept in mind, that while the magnet 42 is used for releaseable attachment of the cutting blade tool 28 to the measurement bar 14, other types of attachment means are contemplated and could be used equally well.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A portable cutter used for cutting along a length of a roll of thin sheet material received inside an open top storage box and unrolled therefrom, the portable cutter comprising:

a removable, right angle measurement bar with a horizontal portion having a scale thereon and a vertical portion, the measurement bar adapted for attachment to a front side of the open top storage box;

at least one cutting blade tool, the cutting blade tool removable and adjustable along a length of the horizontal portion of the measurement bar, the cutting blade tool including an upper guide arm and a lower guide arm, opposite ends of a cutting blade are attached to the guide arms, the cutting blade is disposed perpendicular to the length of the thin sheet material for cutting the thin sheet material;

a space between the upper guide arm and the lower guide arm disposed above the horizontal portion of the measurement bar for guiding the thin sheet material on top of the horizontal portion during the operation of the portable cutter; and magnetic attachment means extending outwardly from one end of the lower guide arm, the magnetic attachment means for releasably engaging the horizontal portion of the measurement bar;

whereby when adjusting the cutting blade tool along the length of the measurement bar, different widths along the length of the thin sheet material can be cut as the material is unrolled from the storage box, the measurement bar also used as a cutting edge for cutting the thin sheet material to length.

2. The portable cutter as described in claim 1 wherein the magnetic attachment means is a magnet holder with magnet mounted thereon, the magnet used for releasable attachment to the measurement bar.

3. The portable cutter as described in claim 1 wherein the magnetic attachment means is a magnet holder with magnet mounted thereon, the magnet used for releasable attachment to a metal strip attached to an underside of the horizontal portion of the measurement bar.

4. The portable cutter as described in claim 1 further including a pair of cutting blade tools spaced apart and adjustably mounted along the length of the horizontal portion of the measurement bar for cutting various widths of the thin sheet material.

5. A portable cutter used for cutting along a length of a roll of thin sheet material received inside an open top storage box and unrolled therefrom, the portable cutter comprising:

a removable, right angle measurement bar with a horizontal portion having a scale thereon and a vertical portion, the measurement bar adapted for attachment to a front side of the open top storage box;

at least one cutting blade tool, the cutting blade tool removable and adjustable along a length of the horizontal portion of the measurement bar, the cutting blade tool including an upper guide arm and a lower guide arm, opposite ends of a cutting blade are attached to the guide arms, the cutting blade is disposed perpendicular to the length of the thin sheet material for cutting the thin sheet material;

a space between the upper guide arm and the lower guide arm disposed above the horizontal portion of the measurement bar for guiding the thin sheet material on top of the horizontal portion during the operation of the portable cutter; and a magnetic holder with a magnet mounted thereon, the magnetic holder extending outwardly from one end of the lower guide arm, the magnet for releasably engaging a metal strip attached to an underside of the horizontal portion of the measurement bar;

whereby when adjusting the cutting blade tool along the length of the measurement bar, different widths along the length of the thin sheet material can be cut as the material is unrolled from the storage box, the measurement bar also used as a cutting edge for cutting the thin sheet material to length.

6. The portable cutter as described in claim 5 wherein the magnet holder includes an upwardly extending bumper stop, the bumper stop engaging a side of the horizontal portion of the measurement bar when the magnet holder is attached thereto.

7. The portable cutter as described in claim 5 further including a pair of cutting blade tools spaced apart, the cutting blade tools adjustably mounted along the length of the horizontal portion of the measurement bar for cutting various widths of the thin sheet material.

8. A portable cutter used for cutting along a length of a roll of thin sheet material received inside an open top storage box and unrolled therefrom, the portable cutter comprising:

a removable, right angle measurement bar with a horizontal portion having a scale thereon and a vertical portion, the measurement bar adapted for attachment to a front side of the open top storage box;

a pair of cutting blade tools, the cutting blade tools removable and adjustable along a length of the horizontal portion of the measurement bar, the cutting blade tools including an upper guide arm and a lower guide arm, opposite ends of a cutting blade are attached to the guide arms, the cutting blade is disposed perpendicular to the length of the thin sheet material for cutting the thin sheet material;

a space between the upper guide arm and the lower guide arm disposed above the horizontal portion of the measurement bar for guiding the thin sheet material on top of the horizontal portion during the operation of the portable cutter; and a magnetic holder with a magnet mounted thereon, the magnetic holder extending outwardly from one end of the lower guide arm, the magnet for releasably engaging a metal strip attached to an underside of the horizontal portion of the measurement bar;

whereby when adjusting the cutting blade tools along the length of the measurement bar, different widths along the length of the thin sheet material can be cut as the material is unrolled from the storage box, the measurement bar also used as a cutting edge for cutting the thin sheet material to length.

9. The portable cutter as described in claim 8 wherein the magnet holder includes an upwardly extending bumper stop, the bumper stop engaging a side of the horizontal portion of the measurement bar when the magnet holder is attached thereto.

* * * * *